US005330042A

United States Patent [19]

Ogimura et al.

[11] Patent Number: 5,330,042

[45] Date of Patent: Jul. 19, 1994

[54] ESCALATOR APPARATUS

[75] Inventors: Yoshio Ogimura, Saitama; Megumi Ookubo, Kanagawa, both of Japan

[73] Assignee: Kabushiki Kaisha Toshiba, Kawasaki, Japan

[21] Appl. No.: 8,140

[22] Filed: Jan. 25, 1993

[30] Foreign Application Priority Data

Jan. 23, 1992 [JP] Japan ..... 4-010047
Feb. 18, 1992 [JP] Japan ..... 4-030832

[51] Int. Cl.[5] ..... B66B 23/12
[52] U.S. Cl. ..... 198/333
[58] Field of Search ..... 198/333, 322, 326

[56] References Cited

U.S. PATENT DOCUMENTS 4,557,369 12/1985 Ishida et al. ..... 198/333
4,681,207 7/1987 Goto et al. ..... 198/333
4,682,681 7/1987 Teranishi et al. ..... 198/333
5,024,314 6/1991 Kitamura et al. ..... 198/333
5,062,519 11/1991 Haruta ..... 190/333

FOREIGN PATENT DOCUMENTS 3046203 7/1982 Fed. Rep. of Germany .
59-203085 11/1984 Japan .
63-19437 4/1988 Japan .
63-51956 10/1988 Japan .
1-261195 10/1989 Japan .
2-8190 1/1990 Japan .
2-13593 1/1990 Japan .
2-100989 4/1990 Japan .
2-100990 4/1990 Japan .

*Primary Examiner*—Joseph E. Valenza
*Attorney, Agent, or Firm*—Foley & Lardner

[57] ABSTRACT

An escalator is arranged such that a first special step having a movable footplate capable of rising and falling is combined with a second special step adjacent to the upstream side of the first special step and having a projectable and retractable lift mechanism. The projectable and retractable lift mechanism supports the movable footplate of the first special step in part of a plurality of running steps provided endlessly in a line. When mounting a wheelchair, the movable footplate runs along the inclined path area with the movable footplate supported at the same height as the second special step by operating the lift mechanism in the horizontal path area of the travel path. The movable footplate ensures a rearward footplate dimension sufficient to carry the wheelchair. Accordingly, the wheelstops for the front wheels of the wheelchair are made to project, thereby better defining the wheelchair carrying position and improving the safety and shortening the time taken when mounting and transporting a wheelchair.

5 Claims, 9 Drawing Sheets

ESCALATOR APPARATUS

BACKGROUND OF THE INVENTION

1. Field of the Invention

This invention relates to an escalator apparatus which can transport cars or wheeled conveyances, for instance prams or wheelchairs and the like, in addition to passengers. In particular, it relates to an escalator apparatus which is arranged with wheelstops for wheels of the cars such as prams or wheelchairs.

2. Description of the Related Art

For instance, an escalator apparatus described above is disclosed by Japanese Patent Publication No. 63-51956. The escalator disclosed the publication comprises wheelstops for rear wheels which wheelstops are provided in a position near to a back end of a movable footplate in a first special step in order to prevent a wheelchair from rolling off, and a wheel stop drive mechanism is provided as a means for moving the wheelstops for the rear wheels so as to project and retract in holes in the movable footplate of a first special step, guided by guides. Further one edge part of each of the wheelstops is formed fork-shaped, and the fork-shaped parts are constructed to project and retract from the first special step.

However, because first, second and third special steps assume a state whereby surfaces of all of an upper part of the footplates are at a uniform height and horizontal in a horizontal path area at a bottom of a travel path, and the wheelstops retract to a bottom of the special steps by the holes in the movable footplate, it is not clear where the wheelchair should be placed in this state.

Therefore, if the wheelchair is placed in a wrong position, there is a risk of it becoming extremely unstable as the rear wheels come to project above the movable footplate of the first special step from behind, or the wheelchair may be mispositioned on the first and second special steps and lean on the inclined path. Further as the wheelstops are formed fork-shaped and the fork-shaped parts are constructed to project and retract from the first special step, there are problems about strength such that it is easy to break and so on.

Moreover, if a carrying area of the wheelchair is not well defined, there are problems in that the operation of placing the wheelchair takes time, it is difficult to place the wheelchair while the escalator is continuing to operate, and it has not proved possible to provide for a reduction in the time taken to convey the wheelchair.

Further in the escalator as described above, a wheelstop projecting and retracting mechanism is completely separated from the wheelstop drive mechanism once the movable footplate has risen relative to a main step body under the support of the lift mechanism.

This is because the wheelstop projecting and retracting mechanism, which makes the wheelstops for the rear wheels move to project or retract in linked movement with the wheelstop drive mechanism, is mounted within the movable footplate, and the wheelstop drive mechanism, which obtains rotational drive force by bias from the main escalator structure, is mounted in the main step body which is the non-rising portion of the first special step in order to move the wheelstops for the rear wheels so as to project or retract.

In other words, a pinion of the wheelstop projecting and retracting mechanism is separated from a chain of the wheelstop drive mechanism.

In this separated state, there is the problem that the wheelstops for the rear wheels drop down due to running vibration and the like since the wheelstop projecting and retracting mechanism is free and the holding force on the wheelstops for the rear wheels is lost. A special-purpose holding mechanism is needed to prevent this.

Moreover, since the wheelstop drive mechanism within the main step body, which is the non-rising portion, is also independent and becomes free, a holding mechanism is also needed to prevent a holding pin, which meshes with a drive pinion, from becoming mispositioned due to running vibration or the like.

Consequently there is the problem that it is also necessary to provide two independent holding mechanisms in one of the special steps, which greatly complicates the construction.

Further, although the wheelstop projecting and retracting mechanism does separate and re-engage with the wheelstop drive mechanism, there is a possibility that if, for example, alignment is poor during re-engagement, the pinion may not mesh smoothly with the chain with the result that these two members may experience friction, motive force may not be transmitted smoothly, and the wheelstops for the rear wheels may not be able to move to project and retract properly.

Further, an escalator apparatus as another related art is disclosed by Early japanese Patent Laid Open Publication (Kokai) Sho. 61-178391.

In FIGS. 1 and 2, a laterally elongate pinion 100 is freely rotatably journalled within leading step 101 having a support plate 101*a* and a pair of left and right racks 102*a* and 102*b* mesh with the pinion 100 such that they can be alternately raised and lowered in the vertical direction. The pair of left and right racks 102*a* and 102*b* are provided with a respective pair of rollers 103*3* and 103*b* such that the two racks 102*a* and 102*b* can be alternately raised and lowered. The pinion 100 is linked to racks 104*a* of engaging element 104 by means of gearwheel mechanisms such that they can be slid forward and backward. An operating lever 105 of the pinion 100 is vertically mounted on a support shaft 106 on lower truss 107. A stop switch 108 is provided beside the top end of the operating level 105 to enable driving of the escalator to be stopped.

Accordingly, as shown in FIGS. 3 through 5, on conveying the wheelchair, by using a call button 109 provided at the level portion at the embarkation point to change over a switch 110, a drive device 111 is driven, with the result that a rack 111*a* rotates a pinion 112*a*. A bevel gear 112*b* of transmission shaft 113 of the pinion 112*a* therefore rotates the bevel gear 113*a* meshing therewith. When this happens, pinions 114*a* and 114*b* of rotary shaft 112 move racks 115*a* meshing therewith rearwards, causing engaging elements 115 that are unitary with the racks 115*a* to project rearwards and then stop. The engaging elements 115 are thus brought into engagement with a stop portion 116*a* of horizontal support mechanism 117.

As a result, as shown in FIG. 6, as moving steps 118 move along the inclined portion of guide rail 119, horizontal support mechanism 117 is extended upwards so that footplate 120 of a following step 120*a* is held horizontally at the same height as the leading step 101.

Since, as shown in FIG. 1, rotation of pinion 100 raises the rack 102*a* whereas the other rack 102*b* is in contrast lowered, the wheelchair can be operated in the ordinary condition without engaging elements 115 interfering with the operating level 105.

However, if for some reason the engaging element 115 is not effectively operated and the rack 102*a* is not raised, the engaging element 115 remains projecting rearwards with the result that the rack 102*b* strikes the operating lever 105. This turns the operating lever 105 rightwards about the support shaft 106, causing it to operate the stop switch 108, stopping operation of the escalator.

Escalator operation is also stopped at the getting-off point by operation of stop switch 108 in the same way.

However, in the escalator described above, the amount of extension or retraction of racks 102*a* and 102*b* is determined in accordance with the amount of operation of engaging elements 115 so if operation of the engaging elements 115 were to be halted midway, the racks 102*a* and 102*b* would also be arrested midway. Thus, the operation of operating lever 105 is not positive. In addition, there would be a risk of damaging adjacent moving steps. Overbalancing of the wheelchair might also be expected.

SUMMARY OF THE INVENTION

It is an object of this invention to provide an escalator wherein a carrying position for cars such as wheelchairs or prams is well defined, safety is improved, and the time for placing and transporting the cars is shortened.

Another object of this invention is to provide an escalator which allows the construction to be simplified and wheelstops to move to project and retract properly by keeping the wheelstop projecting and retracting mechanism continuously linked with a wheelstop drive mechanism without separating even when a movable footplate rises or falls relative to a non-rising portion of a first special step.

A further object of this invention is to provide an escalator wherein there is no problem about breakage in the fork-shaped part of the wheelstop.

A further object of this invention is to provide an escalator wherein it is possible to make sure a wheelstop on a step surface of an upper part of a footplate both projects and retracts.

A further object of this invention is to provide an escalator wherein it is possible to judge easily which step a car such as a wheelchair or a pram may be carried on.

A further object of this invention is to provide an escalator wherein operation of the engaging element of the leading step is accurately sensed so that operation is performed reliably, enabling a car such as a wheelchair or a pram to be transported safely.

Other and further objects, features and advantages of this invention will appear more fully from the following description.

In order to achieve the above objects, this invention provides an escalator having a plurality of steps provided endlessly in a line and running between mounting and dismounting areas, for carrying passengers and a wheeled conveyance comprising (a) a first special step having a movable footplate capable of rising and falling; and (b) a second special step adjacent to the first special step, having a lift mechanism capable of projecting and retracting for supporting the movable footplate, a wheelstop mechanism capable of projecting and retracting in linked movement with the lift mechanism, for stopping wheels of the wheeled conveyanace;

(c) wherein, when the wheeled conveyance is mounted, the lift mechanism projects in a horizontal path area between the mounting and dismounting areas, the movable footplate of the first special step is supported at the same height as the second special step, and the supported movable footplate of the first special step travels along an inclined path area between the mounting and dismounting areas.

Further, this invention provides an escalator having a plurality of steps provided endlessly in a line and running between mounting and dismounting areas, for carrying passengers and a wheeled conveyance comprising (a) a first special step having a movable footplate capable of rising and falling, a wheelstop mechanism capable of projecting and retracting in the movable footplate, a wheelstop drive mechanism for moving the wheelstop mechanism to project and retract; and (b) a second special step adjacent to the first special step, having a lift mechanism capable of projecting and retracting for supporting the movable footplate;

(c) wherein, when the wheeled conveyance is mounted, the lift mechanism projects in a horizontal path area between the mounting and dismounting areas, the movable footplate of the first special step is supported at the same height as the second special step, and the supported movable footplate of the first special step travels along an inclined path area between the mounting and dismounting areas.

Further, this invention also provides an escalator having a plurality of steps provided endlessly in a line and running between mounting and dismounting areas, for carrying passengers and a wheeled conveyance, comprising (a) a wheelstop mechanism in at least some of the steps, capable of projecting and retracting on the respective step, for pulling up the wheeled conveyance; and (b) a movable footplate mounted in said at least some of the steps;

(c) wherein the wheelstop mechanism is a part of the step and is formed to be oblong and wider than the movable footplate.

Further, this invention also provides an escalator having a plurality of steps provided endlessly in a line and running between mounting and dismounting areas, for carrying passengers and a wheeled conveyance, comprising (a) an engaging element having a rack freely horizontally slidably provided in a leading step capable of engaging a footplate of a following step of the steps;

(b) a support frame provided in the leading step;

(c) an abutment rod fitted on the support frame biassed upwardly by means of springs to selectively abut a stop portion of the engaging element;

(d) an operating lever linked to the abutment rod and pivoted to the leading step;

(e) a raising and lowering device, located between the mounting and dismounting areas capable of being freely raised and lowered so as to operate the operating lever;

(f) a sensing switch located between the mounting and dismounting areas and operated by a sensing element of the leading step and by the operating lever; and (g) a stop relay connected to the sensing switch.

DETAILED DESCRIPTION OF THE EMBODIMENTS

An embodiment of this invention will be described below with reference to FIG. 7 to FIG. 12.

Figure 7:
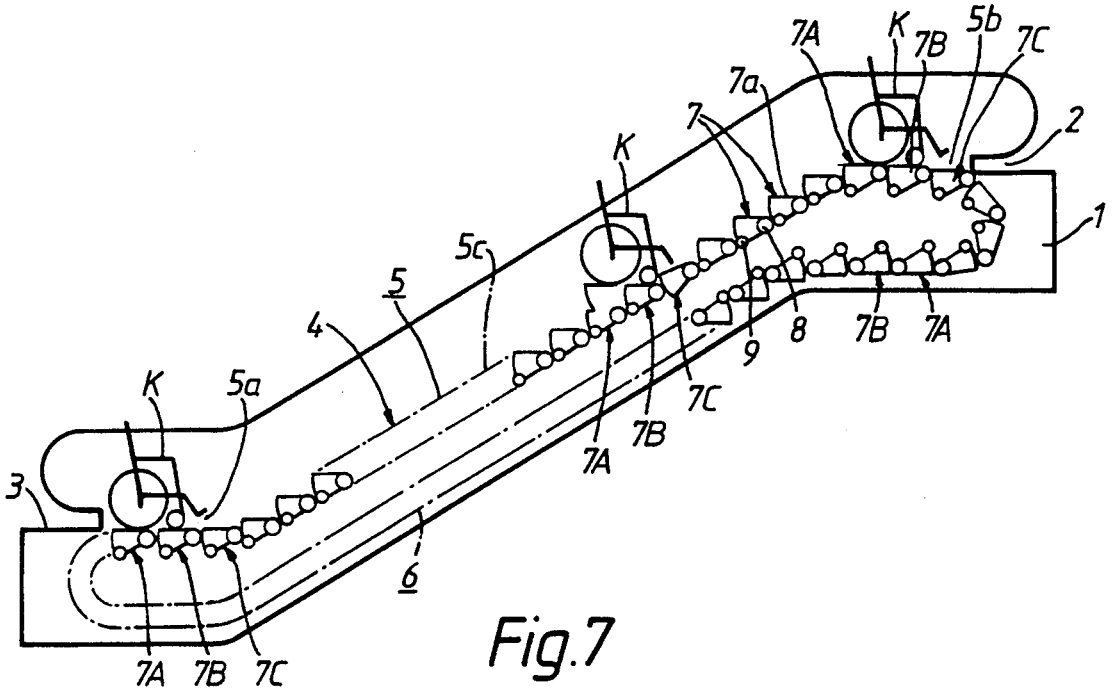
FIG. 7 is a schematic side view of a whole escalator showing an embodiment of the invention.
Figure 8:
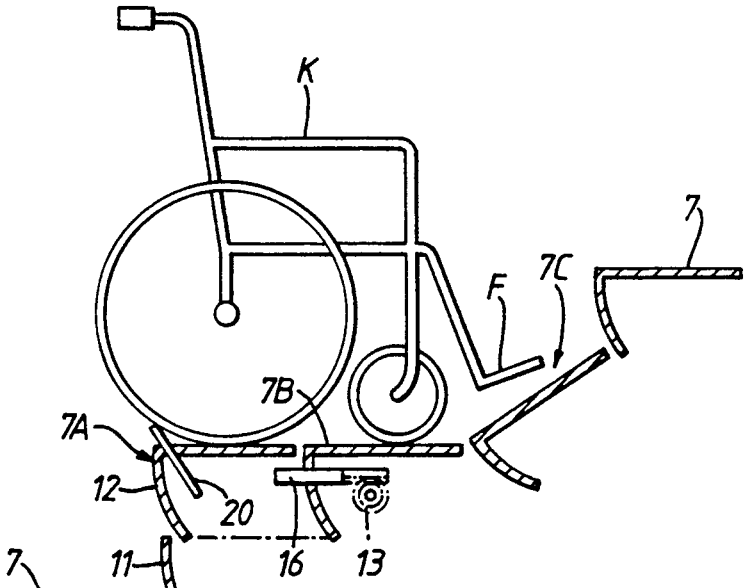
FIG. 8 is a schematic vertical sectional view of steps in an inclined path area of the escalator in FIG. 7.

First of all, in an escalator of this embodiment as shown in FIGS. 7 and 8, a step circuit path 4 is constructed by arranging a guiderail and step sprocket wheels between the mounting and dismounting areas 2 and 3 at the top and bottom of the main escalator structure extending at an angle between an upper and lower floor of a building.

A plurality of steps 7 are provided extending across the upper surface travel path 5, the lower surface return path 6 and the inverting areas at the top and bottom ends of the circuit path 4, these steps 7 being arranged in an endless form by means of a step chain so as to be able to be driven and run. These steps 7 respectively have a footplate 7*a* on the top surface and each have a pair of left and right, front and rear wheels 8 and 9.

Figure 1:
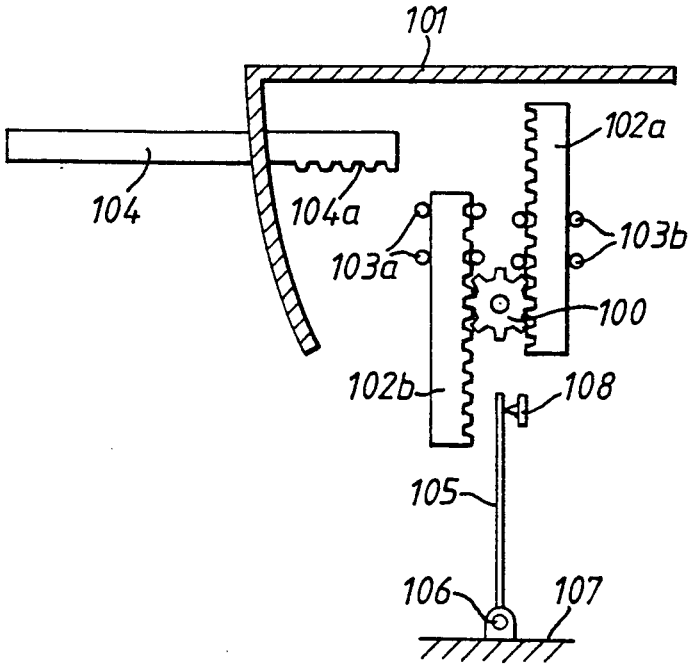
Fig.1 PRIOR ART
FIG. 1 is a cross-sectional view of a related art escalator.
Figure 2:
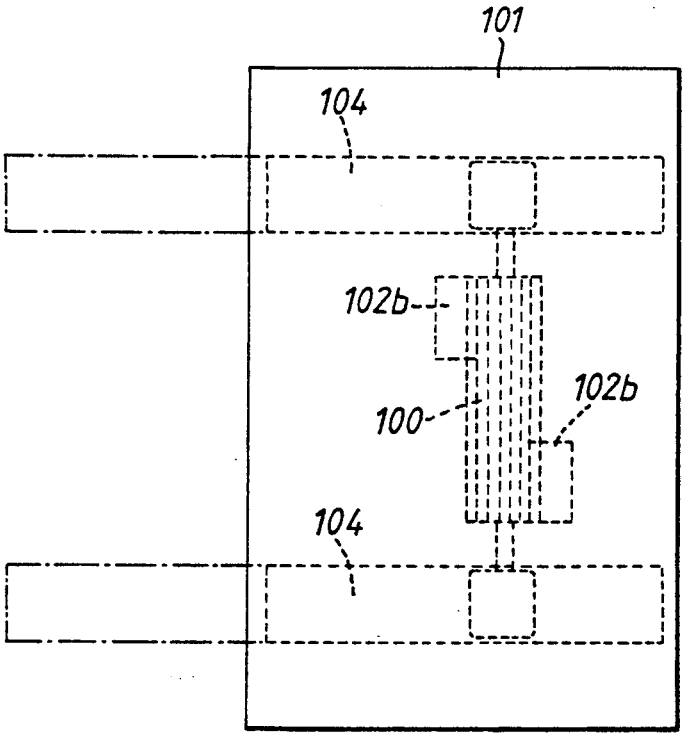
Fig.2 PRIOR ART
FIG. 2 is a plan view of the related art escalator in FIG. 1.

In these plurality of steps 7, two neighboring special upper and lower steps 7A and 7B, on which a wheelchair K is placed, are appropriately specified. Of these two upper and lower steps, as shown in FIG. 2 the first lower special step 7A is constructed in such a way as to be split into a main step body 11 supported by front and rear wheels 8 and 9, and a movable footplate 12 housed in the main step body 11 so as to be able to rise and fall, while the second special step 7B adjacent the first on the upstream side is arranged in such a way as to be similar to an ordinary step 7 except that it has a lift mechanism 13 on the inside.

Figure 3:
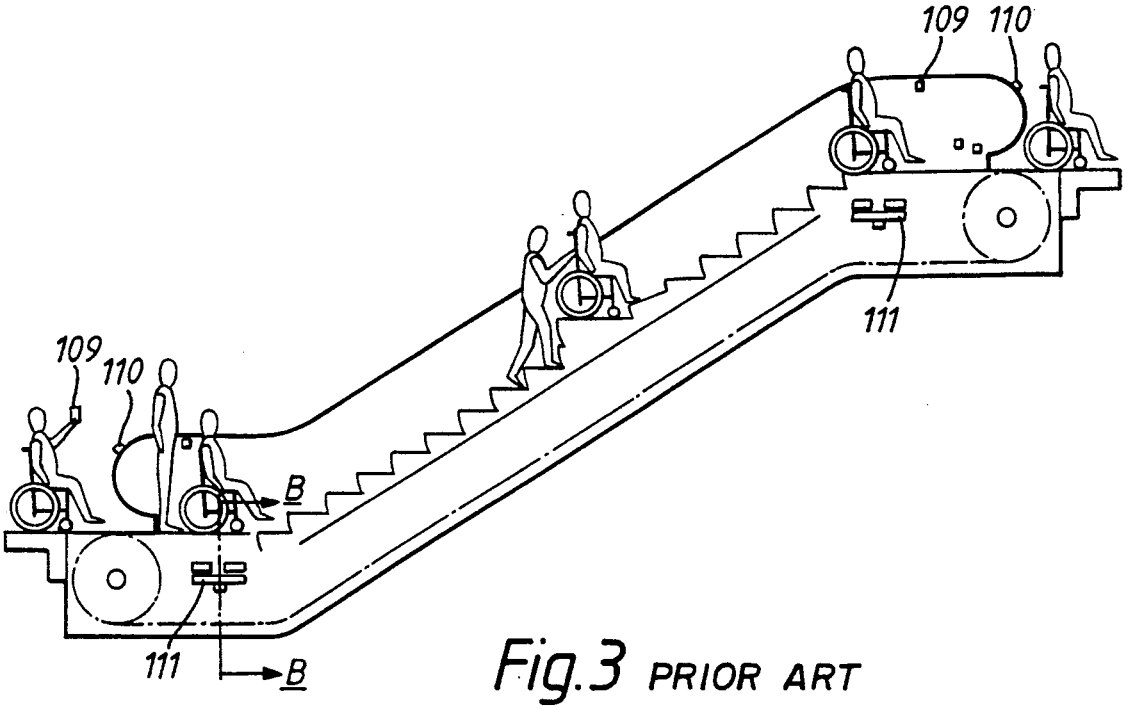
Fig.3 PRIOR ART
FIG. 3 is a side view of the related art escalator.

The first special step 7A and a second special step 7B adjacent to it on the higher level side are combined, as shown in FIG. 3, in one portion of the plurality of steps 7 provided endlessly in a line and running on the step circuit path 4 between the mounting and dismounting areas 2 and 3 at the top and bottom of the escalator.

This first special step 7A is equipped with the movable footplate 12 capable of rising and falling relative to the main step body 11 which is a non-movable portion, and is also equipped with a pair of left and right wheelstops 20 for the rear wheels, capable of projecting and retracting in holes 12*a* towards the rear edge of the movable footplate 12.

The pair of left and right wheelstops 20 are constructed to be oblong and wide block-shape, to prevent damages from occurring in the wheelstops respectively. The surface of the wheelstop 20 has a plurality of ditches as a cleat.

When the wheelstops 20 retract, they become like a same face as the surface of movable footplate 12 and are used as a part of the movable footplate 12.

Accordingly the wheelstops 20 can be seen and confirmed and function as a marker.

The second special step 7B is equipped with an extendable and retractable lift mechanism 13 which supports the rising of the movable footplate 12 of the said first special step 7A.

Moreover, a third special step 7C which assumes a rearward inclined state only in the wheelchair carrying mode is further provided adjacent to these on the higher level side to allow for cases where a sufficient carrying space for the wheelchair K cannot be ensured by the first and second special steps 7A and 7B.

The lift mechanism 13 has a construction comprising a pair of left and right pinions 14 arranged coaxially as before, a pair of left and right racks 15 which mesh with these pinions 14, and a pair of left and right arms 16 which extend rearward from the racks 15.

The lift mechanism 13 is linked with a drive mechanism 31 provided inside and to the bottom of the second special step 7B. This drive mechanism 31 comprises a single vertical drive shaft 32, and a group of bevel gears (not shown) which link the upper end of the drive shaft 32 in drive with the pinion shaft 14*a* the said lift mechanism 13.

Further the drive mechanism 31 comprises drive-linkage gear 33 at the bottom of the drive shaft 32, a drive-linkage gear 34 which meshes with the drive-linkage gear 33, and a drive pinion 35 coaxial with the drive-linkage gear 34.

The drive pinion 35 of the drive mechanism 31 receives rotational drive force by meshing with a drive rack 36 (see FIG. 10) placed as a positioning means in the horizontal path area 5*a* at the bottom of the travel path of the main escalator structure 1. As a result, the pinion shaft 14*a* of the lift mechanism 13 is made to rotate together with the left and right pinions 14, and the left and right arms 16 are thereby made to project, by means of the racks 15, towards the rear from the step-up portion of the second special step 7B so supporting the movable footplate 12 of the first special step 7A from below.

The drive racks 36 are set in the horizontal path areas 5*a* and 5*b* at the upper and lower floor of the travel path of the main escalator structure 1 respectively. The drive racks 36 are usually lowered at the place where they don't mesh with the drive pinion 35, and in the wheelchair carrying mode, the drive racks 36 are raised to a set height, where the drive racks 36 can mesh with the drive pinion respectively, by a motor 37.

Further, both the drive racks 36 are .placed on the right and left opposite direction each other because they make the drive pinion 35 rotate at the upper and lower floor.

Figure 9:
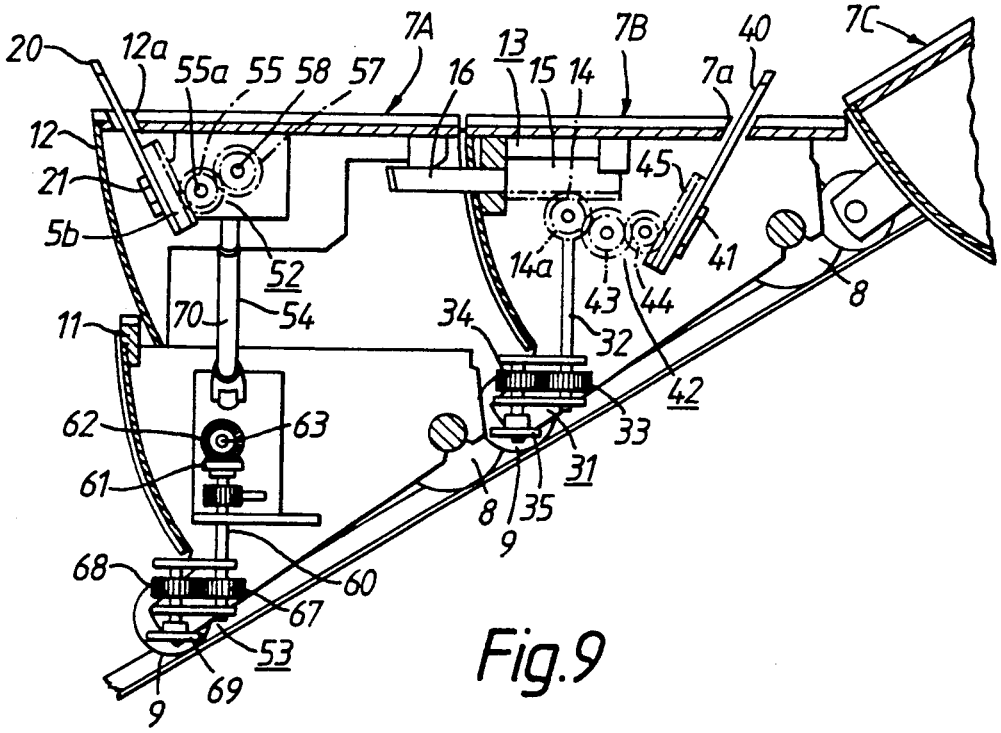
FIG. 9 is a vertical sectional view of the special steps running in the inclined path area, illustrating an embodiment of this invention.
Figure 10:
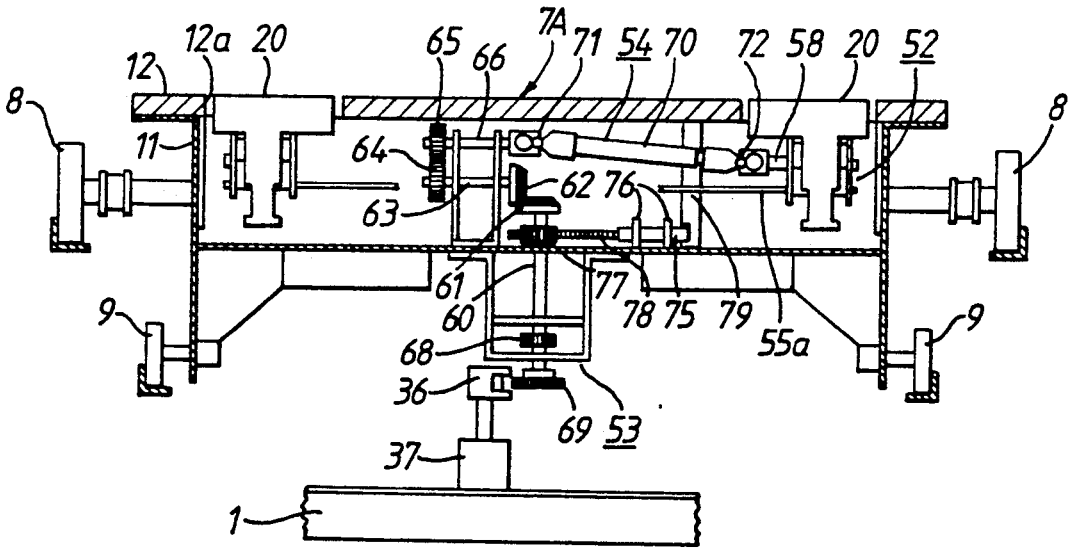
FIG. 10 is a cross-sectional view of the first special step in the horizontal path area, illustrating an embodiment of this invention.

Moreover, as shown in FIG. 9, the second special step 7B is provided with a pair of left and right wheelstops 40 for the front wheels of the wheelchair K which are capable of projecting and retracting the holes 7*b* towards the front edge of the footplate 7*a* along guides 41 in a slightly forward leaning manner. The pair of left and right wheelstops 40 for the front wheels of the wheelchair K is constructed to be oblong and wide block-shape the same as the pair of left and right wheelstops 20 for the rear wheels of the wheelchair K, to prevent damage from occurring in the wheelstops respectively. The surface of the wheelstop 40 has a plurality of ditches the same as the ditches on the surface of the footplate 7*a*. When the wheelstops 40 retract, they become like a same face as the surface of the footplate 7*a* and are used as a part of the footplate 7*a*.

Accordingly, the wheelstops 40 can be seen and confirmed and function as a marker.

Further, the second special step 7B is provided with a wheelstop projecting and retracting mechanism 42 which moves the wheelstops 40 for the front wheels so as to project and retract in linked movement with the lift mechanism 13.

The wheelstop projecting and retracting mechanism 42 for the front wheels is equipped with a pair of left and right transmission gears 43 meshing with the pinions 14 of the lift mechanism 13, and a pair of left and right pinions 44 meshing with these transmission gears 43.

Further, the mechanism 42 is equipped with a pair of left and right racks 45 meshing with these pinions 44, and the left and right wheelstops 40 for the front wheels are provided projecting in a forward-rising manner from the left and right racks 45.

Meanwhile, as shown in FIG. 9 to FIG. 12, the wheelstop drive mechanism 53 and the wheelstop projecting and retracting mechanism 52, acting as a means for moving the wheelstops 20 for the rear wheels so as to retract and project upwards in the holes 12*a* of the movable footplate 12 along the guides 21, are provided in a state whereby they are continually connected by a freely extendable and contractible transmission mechanism 54 in the said first special step 7A. The wheelstop projecting and retracting mechanism 52 for the rear wheels comprises a pair of left and right pinions 55 fitted coaxially by means of a pinion shaft 55*a* inside the movable footplate 12 of the first special step 7A, and a pair of left and right racks 56 meshing with these, and the said wheelstops 20 for the rear wheels are fitted to these racks 56.

Moreover, a drive-linkage shaft 58 is provided in a condition linked in drive to right pinion 55 by means of a drive-linkage gear 57 which meshes with right pinion 55.

The wheelstop drive mechanism 53 for the rear wheels comprises a vertical drive shaft 60 provided inside the main step body 11 which is the non-rising portion, and a first drive-linkage shaft 63 linked in drive by a group of bevel gears 61 and 62 at the top of the drive shaft 60. Further, the mechanism 53 comprises a second drive-linkage shaft 66 linked in drive with this first drive-linkage shaft 63 by means of drive-linkage gears 64 and 65, a drive-linkage gear 67 at the bottom of the said drive shaft 60, and a drive pinion 69 coaxial with a drive-linkage gear 68 which meshes with the drive-linkage gear 67.

The freely extendable and contractible transmission mechanism 54, which constantly connects the wheelstop projection and retraction mechanism 52 for the rear wheels with the wheelstop drive mechanism 53, employs a transmission shaft 70 the length of which is freely extendable or contractible. One end of this transmission shaft 70 is connected by means of a universal joint 71 to the end of the second drive-linkage shaft 66 of the said wheelstop drive mechanism 53 while the other end is connected by means of a universal joint 72 to the end of the drive-linkage shaft 68 of the said wheelstop projecting and retracting mechanism 52.

The drive pinion 69 of the wheelstop drive mechanism 53 for the rear wheels receives a rotational driving force by meshing with the drive rack 36 acting as a positioning means in the horizontal path area 5*a* at the bottom of the travel path of the main escalator structure 1. The left and right pinions 55 of the wheelstop projecting and retracting mechanism 52 are made to rotate by means of the freely extendable and contractible transmission mechanism 54, and the left and right wheelstops 20 for the rear wheels are moved to project in the holes 12*a* of the movable footplates 12 of the first special step 7A and the rear wheels of the wheelchair K are restrained from behind.

The drive pinion 69 of the wheelstop drive mechanism 53 received a reverse-rotation driving force by meshing with a drive rack (not shown) acting as a positioning means in the horizontal path area 5*b* at the top of the travel path, and the left and right pinions 55 of the wheelstop projecting and retracting mechanism 52 are made to rotate in reverse by means of the freely extendable and contractible transmission mechanism 54. The left and right wheelstops 20 are retracted and returned inside the movable footplate 12 of the first special step 7A by means of the racks 56.

Further, the main step body 11 which is the non-rising portion of the first special step 7A is provided with a holding pin 75, which locks and holds, or frees from holding, the movable footplate 12 in the housed state, by means of a guide 76. The holding pin 75 is arranged in such a way that it moves so as to advance or retreat by means of a pinion 77 mounted on the drive shaft 60 of the said wheelstop drive mechanism 53 and a rack 78 with which this meshes and so to engage or disengage with a recessed latching member 79 descending from the movable footplate 12.

Usually, with the escalator with the features described above, the drive racks 36 which are the positioning means in the horizontal path at both the top and bottom of the travel path of the step circuit path are retracted.

Accordingly, the left and right arms 16 of the lift mechanism 13 are not engaged with the first special step 7A but are retracted into the second special step 7B and both the wheelstops 40 and 20 for the front and rear wheels are also retracted. So all the steps 7, 7A, 7B and 7C move as a normal general escalator, and transport passengers.

However, when a wheelchair is to be carried, an attendant operates a switch and the wheelchair-carrying mode is adopted. The drive racks 36, which are the positioning means in the horizontal path areas at both the top and bottom, are then raised to a set height being driven by the motor 37. In this state, when the first and second special steps 7A and 7B move to the horizontal path area at the bottom, firstly the drive pinion 35 of the drive mechanism 31 of the second special step 7B engages with the drive rack 36 and receives a rotational drive force. The left and right pinions 14 of the lift mechanism 13 are made to rotate, and the left and right arms 16 operate to project backward together with the racks 15 meshing with the pinions 14 so that the movable footplate 12 of the first special step 7A is supported from below.

At the same time, the pinions 44 are made to rotate by means of the left and right pinions 14 and transmission gears 43, thereby moving the wheelstops 40 for the front wheels, together with the left and right racks 45, to project above the footplate *7a*.

In this state, the attendant mounts the wheelchair K onto the first and second special steps 7A and 7B from the mounting and dismounting area at the bottom.

The first and second special steps 7A and 7B are then in a state whereby the respective footplates are horizontal at the same height, and, since the pair of left and right wheelstops 40 for the front wheels project above the footplate for the second special step 7B, the loading operation is completed once the attendant has mounted the wheelchair K onto the escalator until its front wheels reach the wheelstops 40 for the front wheels. Thus the wheelchair K can be quickly and properly loaded in the right position on the first and second special steps 7A and 7B.

Then, once the first and second special steps 7A and 7B have run along somewhat and the drive pinion 69 of the wheelstop drive mechanism 53 for the rear wheels at the bottom of the first special step 7A has meshed with the drive rack 36 and received a rotational force, the wheelstop projecting and retracting mechanism 52 is linked in drive with the wheelstop drive mechanism 53 by means of the freely extendable and contractible transmission mechanism 54. Then, the pinions 55 are made to rotate, and the wheelstops 20 for the rear wheels are moved to project upwards by means of the rack 56.

Because the wheelchair is carried in the correct position on the first and second special steps 7A and 7B at this time, as described above, there is no risk that the rear wheels of the wheelchair K will be pushed up and rise as the wheelstops 20 for the rear wheels project above the movable footplate 12. The rear wheels of the wheelchair are properly restrained from behind by the wheelstops 20 for the rear wheels of the wheelchair.

Figure 11:
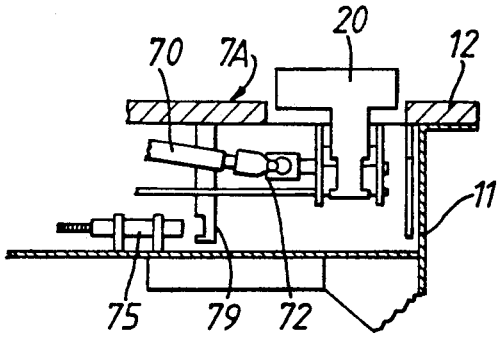
FIG. 11 is a cross-sectional view of part of the first special step illustrating an embodiment of this invention.

Further, at the same time, the holding pin 75 is moved to retract to the left as shown in FIG. 11 in linked movement with the wheelstop drive mechanism 53 by means of the pinion 77 and rack 78 and is freed from the recessed latching member 79. Thus the state of locked housing of the movable footplate 12 of the first special step 7A within the main step body 11 is released.

In this state, the first and second special steps 7A and 7B run carrying the wheelchair, and a step-formation movement is produced by the guiderail for the front and rear wheels in the stage when moving from the horizontal path area at the bottom of the travel path to the inclined path area. However, at this time, the movable footplate 12 of the first special step 7A is raised relative to the main step body 11 and is held at the same height as the second special step 7B as shown in FIGS. 8 and 9 under the support of the left and right arms 16 of the lift mechanism 13.

In this way, a rearward footplate dimension sufficient for carrying a wheelchair K is ensured by keeping the movable footplate 12 of the first special step 7A and the second special step 7B at the same height even when running in the inclined path area *5c*. Thus the wheelchair K being carried is transported stably and safely without the risk that it will lean.

Then, in the stage of moving from the inclined path area of the travel path to the horizontal path area at the top, the movable footplate 12 of the first special step 7A is supported at the same height as the second special step 7B and then first special step 7A drops and is restored relative to the main step body 11.

In this state, the steps run over the level path area at the top, and the drive pinion 35 of the drive mechanism 31 of the second special step 7B is engaged by a drive rack which is the positioning mechanism in mid course and is rotated in reverse, as described above. The left and right arms 16 are retracted from the first special step 7A by the left and right pinions 14 and racks 15 of the lift mechanism 13, so releasing the support of the movable footplate 12 of the first special step 7A.

At the same time, the pinions 44 are rotated in reverse by means of the left and right pinions 14 and transmission gears 43, so retracting the wheelstops 40 for the front wheels together with the left and right racks 45.

In this state, the attendant can push the wheelchair off the escalator from the mounting and dismounting area at the top, after which the drive pinion 69 of the wheelstop drive mechanism 53 for the rear wheels at the bottom of the first special step 7A meshes with the drive rack at the top and is rotated in reverse. The wheelstop projecting and retracting mechanism 52 is linked in movement with the wheelstop drive mechanism 53 by means of the freely extendable and contractible transmission mechanism 54, its pinion 55 is rotated in reverse and the wheelstops 20 for the rear wheels are retracted by means of the racks 56.

At the same time as which the holding pin 75 is linked in drive with the wheelstop drive mechanism 53 by means of a pinion 77 and rack 78 and moves advancing to the right, engages with the recessed latching member 79 and so locks and holds the movable footplate 12 of the first special step 7A housed within the main step body 11. The first and second special steps 7A and 7B then return to the normal running state like the other steps 7.

When the movable footplate 12 of the first special step 7A is lifted under the support of the lift mechanism 13 as described above, the transmission shaft 70 of the transmission mechanism 54 moves obliquely by means of universal joints 71 and 72 while extending so that the wheelstop drive mechanism 53 and the wheelstop projecting and retracting mechanism 52 for the rear wheels are kept in a continually linked state. In this way, the course of the wheelstop drive train is not separated as the movable footplate 12 rises, as was the case previously, friction and poor power transmission can be prevented, and the wheelstops for the rear wheels can always be moved to be projected or retracted properly when in the wheelchair carrying mode.

Further, since the wheelstop projecting and retracting mechanism 52 for the rear wheels is kept in a continually linked state with the wheelstop drive mechanism 53 by the transmission mechanism 54, and does not become free as previously, the wheelstops for the rear wheels are prevented from dropping down due to running vibration and the like simply by providing a single holding mechanism (not shown) also serving for misalignment prevention of the holding pin 75, without needing to provide a dedicated holding mechanism for the wheelstops for the rear wheels.

Because the escalator is arranged as described above, it has the advantage that the wheelchair carrying position is well defined by projecting wheelstops for the front wheels, and safety when mounting and transporting the wheelchair is improved and the time taken shortened.

Because the escalator is arranged as described above, it has the advantage that the construction can be simplified and the wheelstops can move to project and retract properly by keeping the wheelstop projecting and retracting mechanism constantly linked with the wheelstop drive mechanism without separating even when the movable footplate rises relative to the non-rising portion of the first special step.

Further, because the escalator is arranged as described above, it has the advantage that the operation for mounting and transporting the wheelchair works smoothly and it is possible easily to judge which steps the wheelchair may be mounted on.

Another embodiment of this invention is described below with reference to the drawings.

Figure 4:
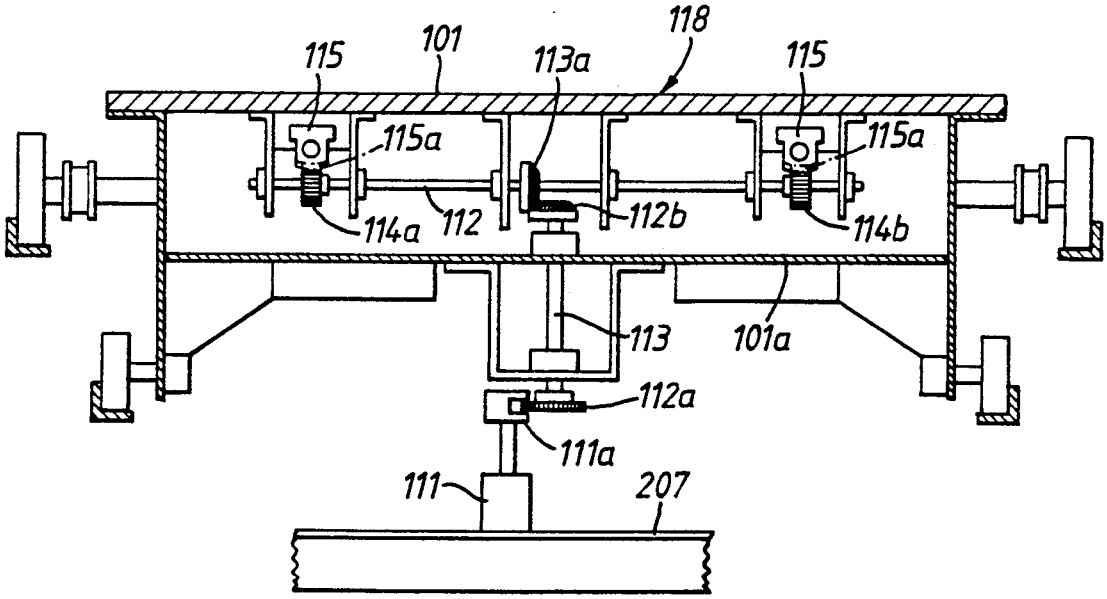
Fig.4 PRIOR ART
FIG. 4 is a cross-sectional view along the chain line B—B in FIG. 3.
Figure 5:
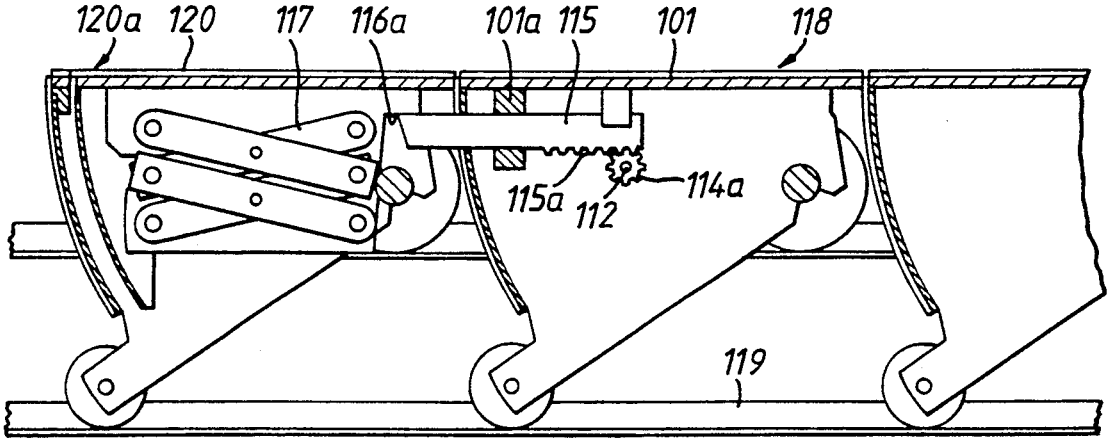
Fig.5 PRIOR ART
FIGS. 5 and 6 are views given in explanation of the action of the related art escalator.
Figure 6:
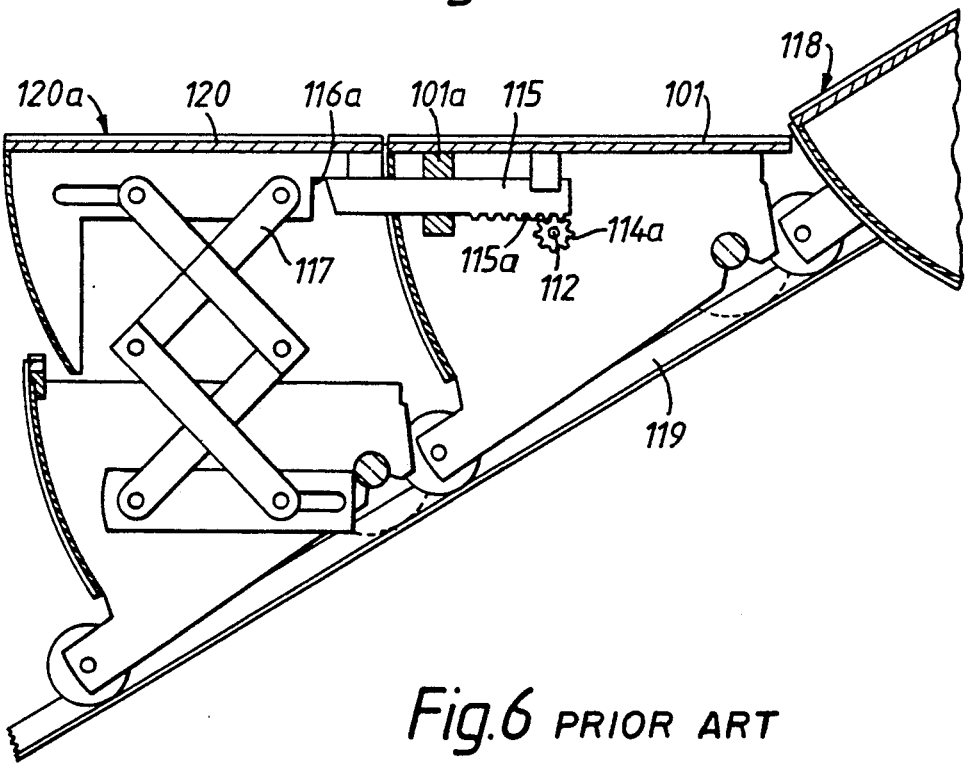
Fig.6 PRIOR ART
Figure 13:
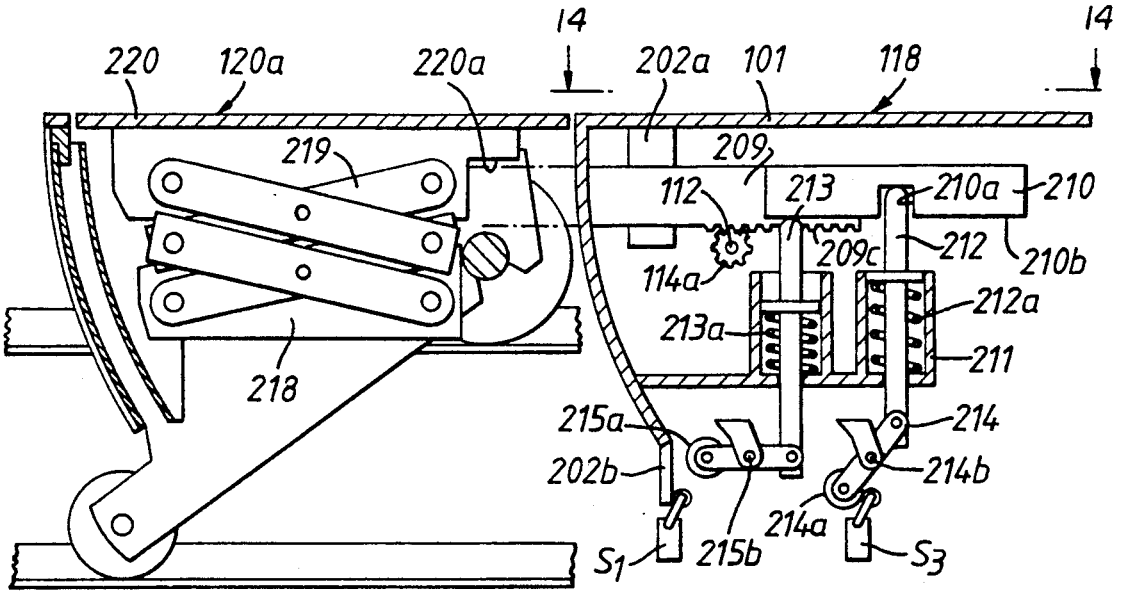
FIG. 13 is a cross-sectional view showing the main part of another embodiment of this invention.
Figure 14:
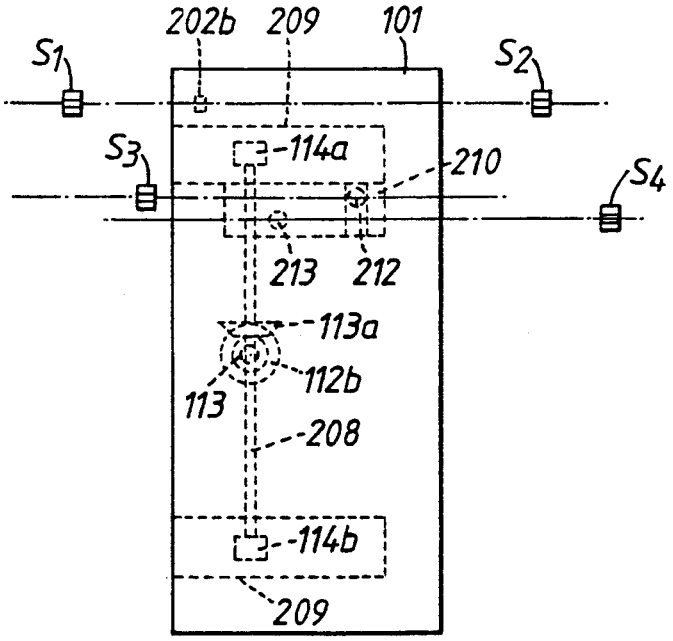
FIG. 14 is a plan view along the chain line 14—14 in FIG. 13.

In FIGS. 4, 13 and 14, when a wheelchair is loaded for transportation, in moving steps 118, a following step 120*a* is provided next to a leading step 101 such that it is of the same height as leading step 101 when the steps are running up the incline.

In more detail, a support plate 101*a* is arranged horizontally within leading step 101. A transmission shaft 113 is journalled such that it passes through the support plate 101*a* vertically at about its middle. A pinion 112*a* and bevel gear 112*b* are journalled at the ends of the transmission shaft 113. The pinion 112*a* meshes with racks 111*a* of respective drive devices 111 arranged at the embarkation point and alighting point of trusses 207. A bevel gear 113*a* of a rotary shaft 112 journalled in a bracket of leading step 101 meshes with the bevel gear 112*b*. Pinions 114*a* and 114*b* are journalled at both ends of the rotary shaft 112. Additionally, as shown in FIG. 13, an engaging element 209 is provided on a guide member 202*a* of leading step 101 in which the pinions and 114*a* and 114*b* are located, such that it can be slid forwards and rearwards. The pinions 114*a* and 114*b* mesh with a rack 209*c* of the engaging element 209. A stop portion 210*a* formed with a downwardly directed recess is provided at about the middle of a stop member 210 which is integral with the engaging element 209. The flat lower face of stop member 210 on the side of the stop portion 210*a* is formed with a sliding face 210*b*.

As shown in FIG. 13, a support frame 211 is provided within the leading step 101. On the support frame 211, a first abutment rod 212 and second abutment rod 213 are fitted with an interval between them, biased upwardly by means of respective coil springs 212*a* and 213*a*, so as to selectively abut stop portion 210*a*. Operating levers 214 and 215 having rollers 214*a* and 215*b* are linked to the respective lower ends of the two abutment rods 212 and 213. The operating levers 214 and 215 are pivoted on the leading step 101 by means of pin shafts 214*b* and 215*b*.

Figure 15:
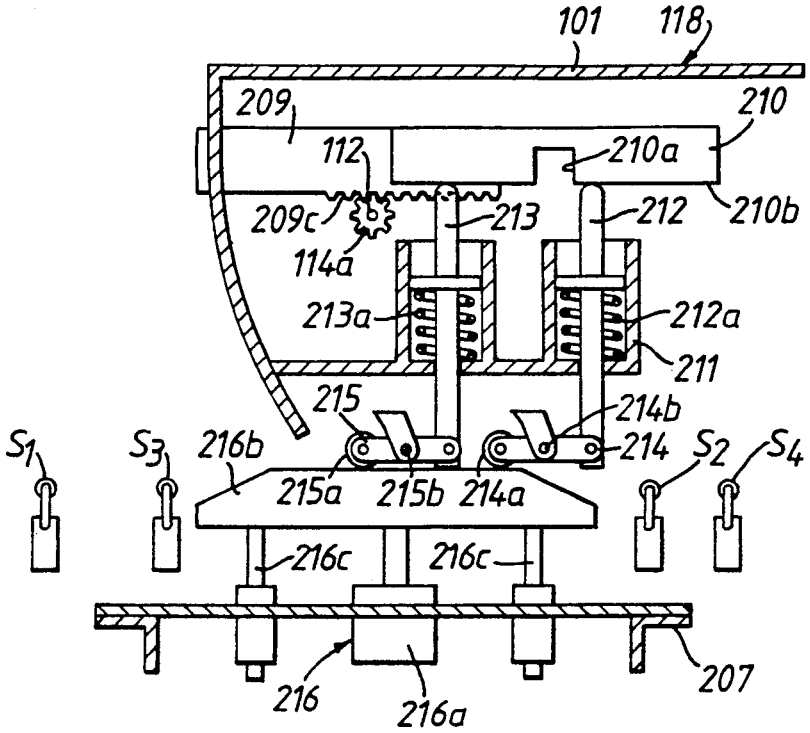
FIG. 15 is a view given in explanation of the action of an another embodiment.
Figure 16:
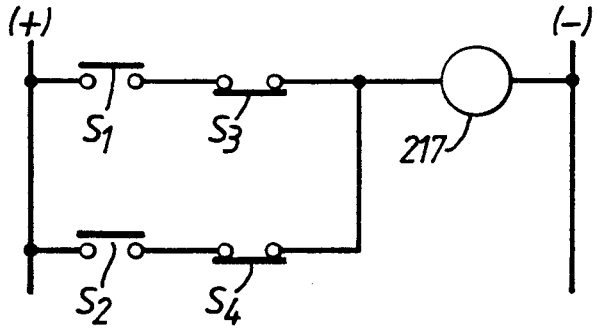
FIG. 16 is a diagram of the electrical circuitry incorporated in another embodiment.

As shown in FIG. 15, at the embarkation point and alighting point of truss 207 of the running path, raising and lowering devices 216 of the operating levers 214 and 215 are arranged so as to be free to be raised and lowered so as to operate the operating levers 214 and 215. The raising and lowering devices 216 are arranged to freely raise and lower vertically a pushing-up element 216*b* on an output shaft of an actuator 216*a*. The pushing-up elements 216*b* are tapered on both sides. Furthermore, the construction is such that the pushing-up elements 216*b* are guided vertically by means of respective guide rods 216*c*.

Furthermore, as shown in FIGS. 13–16, sensing switches S1, S2, S3 and S4 are installed on the running path of operating levers 214 and 215 directly below first abutment rod 212 and second abutment rod 213 and on the running path of a sensing element 202*b* vertically arranged below leading step 101. The sensing switches S1, S2, S3 and S4 are connected to a stop relay 217. When the stop relay 217 is excited, operation of the escalator is stopped.

In more detail, the arrangement is such that sensing switches S1 and S2 are turned ON and OFF by the sensing element 202*b*. The sensing switch S3 is operated by the roller 214*a* of operating lever 214, and the sensing switch S4 is operated by the roller 215*a* of operating lever 215.

Consequently, when a wheelchair is loaded and transported, the sensing element 202*b* of leading step 202 contacts one sensing switch S1, turning it ON. Thereupon, the operating lever 214 of first abutment rod 212 contacts another switch S3, turning it OFF. Thereby, the stop relay 217 is not excited and operation is continued (see FIG. 16). If, however, for some reason, at the embarkation end, engaging element 209 is arrested midway so that it does not move (see FIG. 15), the first and second abutment rods 212 and 213 will be moved away from the stop portion 210*a* of the engaging element 209. Thus, the two operating levers 214 and 215 will both be put into the horizontal condition. When the sensing element 202*b* contacts first-mentioned sensing switch S1, turning it ON, the operating lever 214 of first abutment rod 212 contacts the other sensing switch S3, turning it ON. This excites the stop relay 217 so that it stops the operation. Thus, the wheelchair can be transported with safety.

In contrast, on dismounting the wheelchair, if, for some reason, the engaging element 209 is stopped midway so that it cannot return to its original position (see FIG. 15), the first and second abutment rods 212 and 213 will be separated from the stop portion 210*a* of engaging element 209. As a result, both operating levers 214 and 215 assume the horizontal condition. When the sensing element 202*b* contacts one sensing switch S2, turning it ON, the operating lever 215 of second abutment rod 213 contacts the other sensing switch S4, turning it ON. As a result, the stop relay 217 is excited, stopping operation and so preventing damage to the device.

For its part, as shown in FIG. 13, the following step 120*a* that is linked to the leading step 101 is provided within step 120*a* on the side wall of step 120*a* with a horizontally arranged holding plate 218. The holding plate 218 is provided with an extensible horizontal support mechanism (also called a parallel link mechanism) 219 such as a pantograph. A footplate 220 having a stop 220*a* is provided horizontally at the top of the horizontal support mechanism 219.

The action of the embodiment is described below.

(a) During normal escalator operation:

As shown in FIG. 13, after the drive device 111 (see FIG. 4) has been put into a stopped condition, with the engaging element 209 of leading step 101 in a retracted condition, passengers are transported by moving the moving steps 118 together with a moving handrail (not shown).

(b) When the escalator is to transport a wheelchair:

As shown in FIG. 15, when an invalid's wheelchair is loaded on for transportation, the first abutment rod 212 is lowered against the resilient force of coil spring 212*a* by means of the two operating levers 214 and 215, by operating the raising and lowering device 216 at the embarkation point. The first abutment rod 212 is thereby separated from the stop portion 210*a* of engaging element 209.

Figure 12:
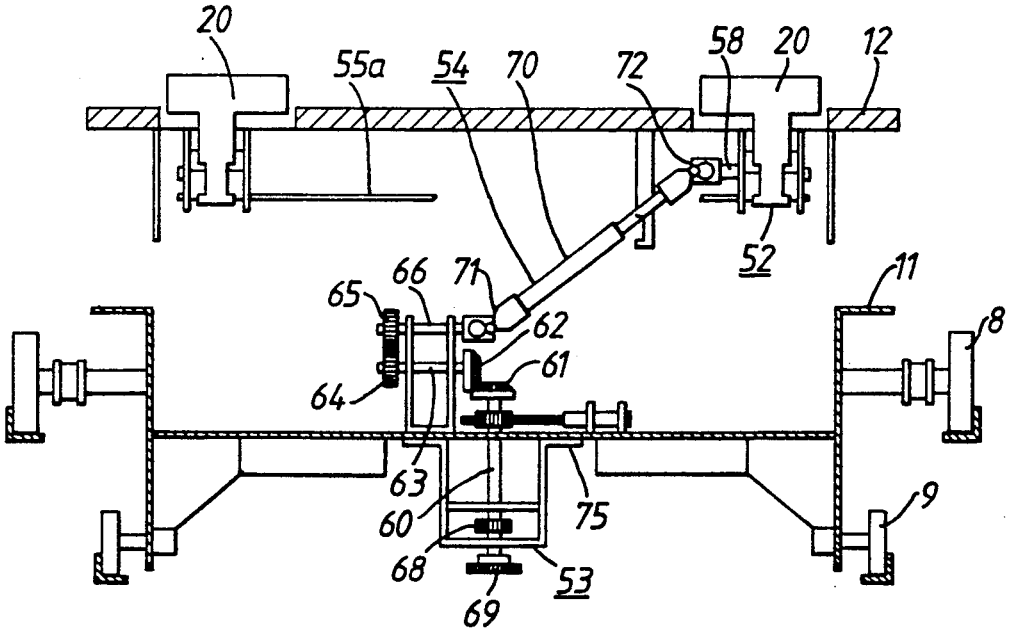
FIG. 12 is a cross-sectional view of the inclined path area of the first special step illustrating an embodiment of this invention.

Next, as shown in FIG. 4, by driving the drive device 111, the rack 111*a* is made to rotate the pinion 112*a*. As a result, the bevel gear 112*b* of the transmission shaft 113 of the pinion 112*a* rotates the bevel gear 113*a* meshing therewith. When this happens, the pinions 114*a* and 114*b* of rotary shaft 112 of the bevel gear 113*a* move the racks 209*c* (see FIGS. 4 and 13) meshing therewith backwards, causing the engaging element 209, which is integral with the racks 209*c*, to project rearwards and then stop. As a result, the engaging element 209 comes into engagement with the stop portion 210*a* of the horizontal support mechanism 219. At the same time, the second abutment rod 213 abuts the stop portion 210*a*, thereby temporarily fixing it. As a result, as shown in FIG. 12, movement of the moving steps 118 along the inclined portion of guide rails (not shown) causes the horizontal support mechanism 219 to extend upwardly so that the wheelchair can be loaded on with the footplate held horizontal at the same height as the leading step 101.

Figure 17:
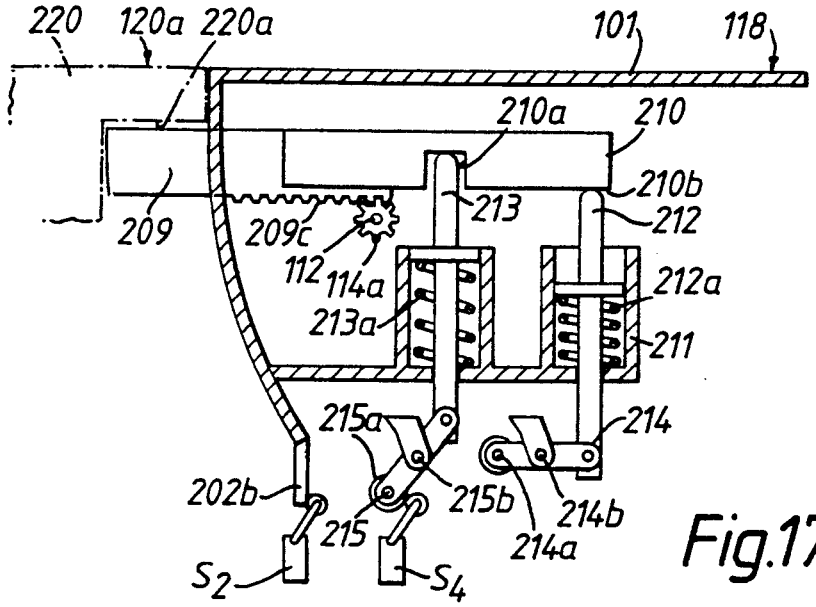
FIGS. 17 and 18 are views given in explanation of the action of another embodiment.

The sensing element 202*b* of the leading step 101 contacts one sensing switch S1 turning it ON and the operating lever 214 of first abutment rod 212 contacts the other sensing switching S3 turning it OFF. Thus the stop relay 217 is not excited and the operation is continued (see FIGS. 13 and 17).

In this way, the following step 120*a* is positioned at the same height as the leading step 101 so that the invalid or attendant can load the wheelchair onto the escalator for transportation.

In the opposite process, as shown in FIG. 3, at the horizontal portion at the alighting end, by changing over a changeover switch 110 by means of the call button 109, the drive device 111 is driven to perform the opposite action to that described above to return the escalator to its original normal operating condition.

Figure 18:
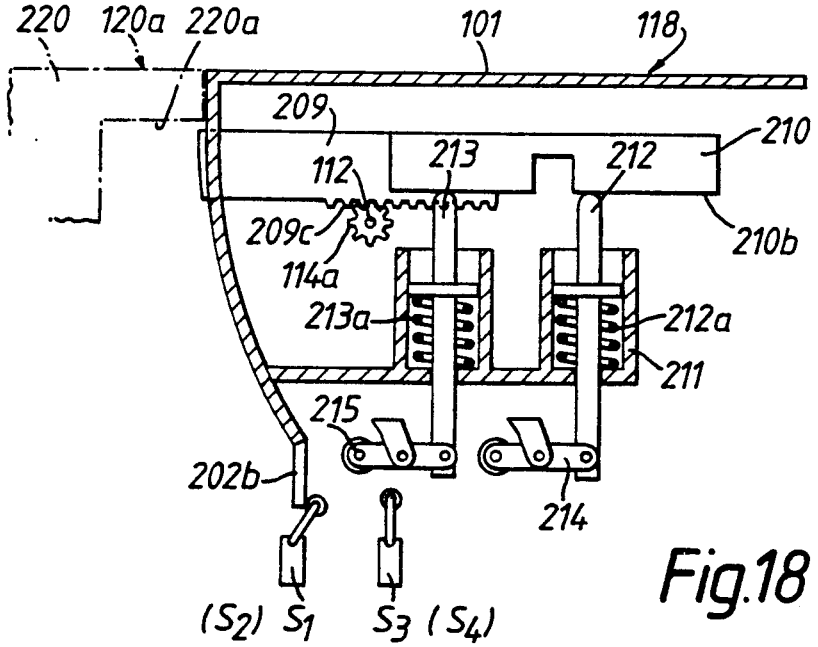

(c) An abnormal escalator operation:

As shown in FIG. 18, if, for some reason, the engaging element 209 is stopped midway so that it does not move at the embarkation end, the first and second abutment rods 212 and 213 remain in the condition separated from the stop portion 210*a* of engaging element 209 with the result that both operating levers 214 and 215 are in the horizontal condition. When the sensing element 202*b* contacts one sensing switch S1 turning it ON, the operating lever 214 of the first abutment rod 212 contacts the other sensing switch S3 turning it ON. The stop relay 217 is thereby excited, stopping operation of the escalator.

In the opposite situation, when the wheelchair is taken off the escalator, if, for some reason, the engaging element 209 is stopped midway so that it cannot return to its original position (see FIG. 18), the first and second abutment rods 212 and 213 stay separated from the stop portion 210*a* of engaging element 209 with the result that both operating levers 214 and 215 are put into the horizontal condition. When one sensing switch S2 is turned ON by contact with the sensing element 202*b*, the other sensing switch S4 is turned ON by contact with the operating lever 215 of the second abutment rod 213, causing the stop relay 217 to be excited, thereby stopping operation and preventing damage to the device.

This embodiment described above therefore offers great benefits in that a car such as a wheelchair can be transported safely and reliably; and in addition, the stop portion of the engaging element can be selectively stopped by the first or second abutment rod; so that there is no risk of mispositioning even if subjected to vibration or shock during transportation, and no possibility of spurious operation or damage to the device.

Other objects, features and advantages of the present invention will become apparent to those skilled in the art from the description above and from practice of the invention. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. An escalator having a plurality of steps provided endlessly in a line and running between mounting and dismounting areas, for carrying passengers and a wheeled conveyance comprising:

(a) a first special step having a movable footplate capable of rising and falling, and a first wheelstop mechanism; and (b) a second special step adjacent to the first special step having a lift mechanism capable of projecting and retracting for supporting the movable footplate, and a second wheelstop mechanism capable of projecting and retracting in linked movement with the lift mechanism, for stopping a wheel of the wheeled conveyance;

(c) wherein, when the wheeled conveyance is mounted, the lift mechanism projects in a horizontal path area between the mounting and dismounting areas, the movable footplate of the first special step is supported at the same height as the second special step, and the supported movable footplate of the first special step travels along an inclined path area between the mounting and dismounting areas.

2. An escalator having a plurality of steps provided endlessly in a line and running between mounting and dismounting areas, the escalator comprising:

(a) an engaging element having a rack freely horizontally slidably provided in a leading step of the steps capable of engaging a footplate of a following step of the steps;

(b) a support frame provided in the leading step;

(c) an abutment rod fitted on the support frame biased upwardly by means of springs to selectively abut a stop portion of the engaging element;

(d) an operating lever linked to the abutment rod and pivoted to the leading step;

(e) a raising and lowering device, located between the mounting and dismounting areas to be freely raised and lowered so as to operate the operating lever;

(f) a sensing switch located between the mounting and dismounting areas, and operated by a sensing element of the leading step and by the operating lever; and (g) a stop relay connected to the sensing switch.

3. An escalator having a plurality of steps provided endlessly in a line and running between mounting and dismounting areas, for carrying passengers and a wheeled conveyance comprising:

(a) a first special step having a movable footplate capable of rising and falling, a wheelstop mechanism capable of projecting and retracting in the movable footplate, and a wheelstop drive mechanism for moving the wheelstop mechanism to project and retract; and (b) a second special step adjacent to the first special step, having a lift mechanism capable of projecting and retracting for supporting the movable footplate, (c) wherein, the wheelstop drive mechanism comprises a power generating mechanism, mounted in a non-rising portion of the first special step, for generating a projecting and retracting drive force for the wheelstop, a wheelstop projecting and retracting mechanism, mounted in a lower portion of the movable footplate, for moving the wheelstop to project and retract in linked movement with the power generating mechanism, and a transmission mechanism capable of extending and contracting freely, for connecting the power generating mechanism with the wheelstop projecting and retracting mechanism regardless of a rising or falling of the movable footplate.

4. An escalator as claimed in claim 3, wherein the wheelstop mechanism is a part of the first special step, and includes a portion formed to be oblong and greater in width than in length.

5. An escalator as claimed in claim 3, wherein the wheelstop mechanism is a first wheelstop mechanism; and wherein the second special step includes a second wheelstop mechanism capable of projecting and retracting in linked movement with the lift mechanism.

* * * * *